US006745606B2

(12) United States Patent
Kazuyoshi

(10) Patent No.: US 6,745,606 B2
(45) Date of Patent: Jun. 8, 2004

(54) DEVICE AND METHOD FOR BENDING CYLINDER EDGE

(75) Inventor: Takagi Kazuyoshi, Shizuoko-ken (JP)

(73) Assignee: Kabushiki Kaisha Moric, Mori-machi (JP)

( * ) Notice: Subject to any disclaimer, the term of this patent is extended or adjusted under 35 U.S.C. 154(b) by 0 days.

(21) Appl. No.: 10/248,453

(22) Filed: Jan. 21, 2003

(65) Prior Publication Data

US 2003/0167814 A1 Sep. 11, 2003

(30) Foreign Application Priority Data

Mar. 5, 2002 (JP) ..... 2002-058173

(51) Int. Cl.[7] ..... B21D 3/02

(52) U.S. Cl. ..... 72/115; 72/117; 72/118; 72/120; 29/511

(58) Field of Search ..... 72/67, 82, 83, 72/112, 115, 120, 121, 122, 123, 124, 125, 118, 117; 29/509–511

(56) References Cited

U.S. PATENT DOCUMENTS

| | | | | |
|---|---|---|---|---|
| 4,064,726 A | * | 12/1977 | Hinze | 72/70 |
| 4,574,607 A | * | 3/1986 | Akino et al. | 72/112 |
| 4,747,287 A | * | 5/1988 | Azzaline et al. | 72/125 |
| 5,165,267 A | * | 11/1992 | Watanabe et al. | 72/118 |
| 6,519,993 B2 | * | 2/2003 | Even | 72/112 |

* cited by examiner

*Primary Examiner*—Ed Tolan
(74) *Attorney, Agent, or Firm*—Ernest A Beutler

(57) ABSTRACT

An apparatus and method for forming cylindrical magnetic assemblies for rotating electrical machines. The apparatus and method pre-bends and finally bends a flange of the supporting shell to lock the permanent magnets in place. This is done in a single station and in two steps by way of an apparatus that permits handling of cylindrical bodies of considerably different diameters and lengths.

19 Claims, 5 Drawing Sheets

DEVICE AND METHOD FOR BENDING CYLINDER EDGE

BACKGROUND OF INVENTION

This invention relates to an apparatus and method for forming cylindrical magnet assemblies for rotating electrical machines.

In many forms of rotating electrical machines, there is provided a cylindrical shell that contains a plurality of circumferentially spaced permanent magnets. Generally these magnets are retained within the shell by a magnet case that is complimentary to the shell. However, recently the use of high energy neodymium based magnets has replaced ferrite based magnets. By using these high energy neodymium based magnets, it is possible to increase the magnetic intensity while at the same time, reducing the size of the components. However, because of their high magnetic strength, it is necessary to insure that the magnets are rigidly held within the cylindrical shell.

One way it is proposed to maintain the magnets in position is to deform or fold the edge of the shell into engagement with the magnets so that they are trapped between two flanges thus formed on the shell. However, the previous methods for forming this have resulted in a cumbersome operation which has been difficult to obtain automatically and required two separate forming steps in different stations.

It is, therefore, a principle object to this invention to provide an improved and simplified apparatus and method for assembling the permanent magnets of a rotating electrical machine.

It is a further object to this invention to provide an improved method and apparatus for retaining the permanent magnets in position within a cylindrical shell, which is versatile and can be adapted for use with various sized shells.

SUMMARY OF INVENTION

A first feature of the invention is adapted to be embodied in a machine for folding over a peripheral flange of a cylindrical shell. The apparatus comprises a support for the shell, a forming tool having a pre-bending section and a final bending section angularly related to each other about a plane extending parallel to the support and a drive. The drive is effective to cause relative axial movement of the support and the forming tool to bring the forming tool into engagement with a peripheral flange of a shell positioned on the support. The drive also effects relative radial movement of the support and the forming tool for determining which of section of the forming tool engages the peripheral flange of the shell positioned on the support. In addition, the drive effects relative rotation of the support and the forming tool to deform a circumferential portion of the peripheral flange of the shell positioned on the support. A control operates the drive for first partially bending the peripheral flange of the shell positioned on the support around a circumferential area by the pre-bending section of the forming tool and then completes the bending thereof by the final bending section of the forming tool.

Another feature of the invention is embodied in a method of forming a magnet assembly for a rotating electrical machine. The method comprises the steps of forming a shell having a cylindrical section open at one end and at least partially closed at its other end by a radially extending end wall extending radially inwardly from the cylindrical section and an extending section thereof at the open end of said shell. A plurality of magnetic sections are placed within the shell with their outer periphery in engagement with the inner surface of the cylindrical section and one end thereof in engagement with the end wall. The extending section of the shell is initially bent toward the magnetic sections by bringing a first section of a forming tool into axial contact therewith and then continuing to bend a circumferential extent of the extending section by effecting relative rotation between the shell and the forming tool around the axis of the cylindrical section. Then the extending section is finally bent of into locking engagement with the magnetic sections by bringing a second section of the forming tool into contact with the extending section and effecting relative rotation between the shell and the forming tool around the axis of the cylindrical section.

BRIEF DESCRIPTION OF DRAWINGS

FIG. 5 shows the forming tools before engagement with the work piece.

FIG. 6 shows the initial pre-bending forming operation.

FIG. 7 shows the final bending operation.

DETAILED DESCRIPTION

Figure 1:
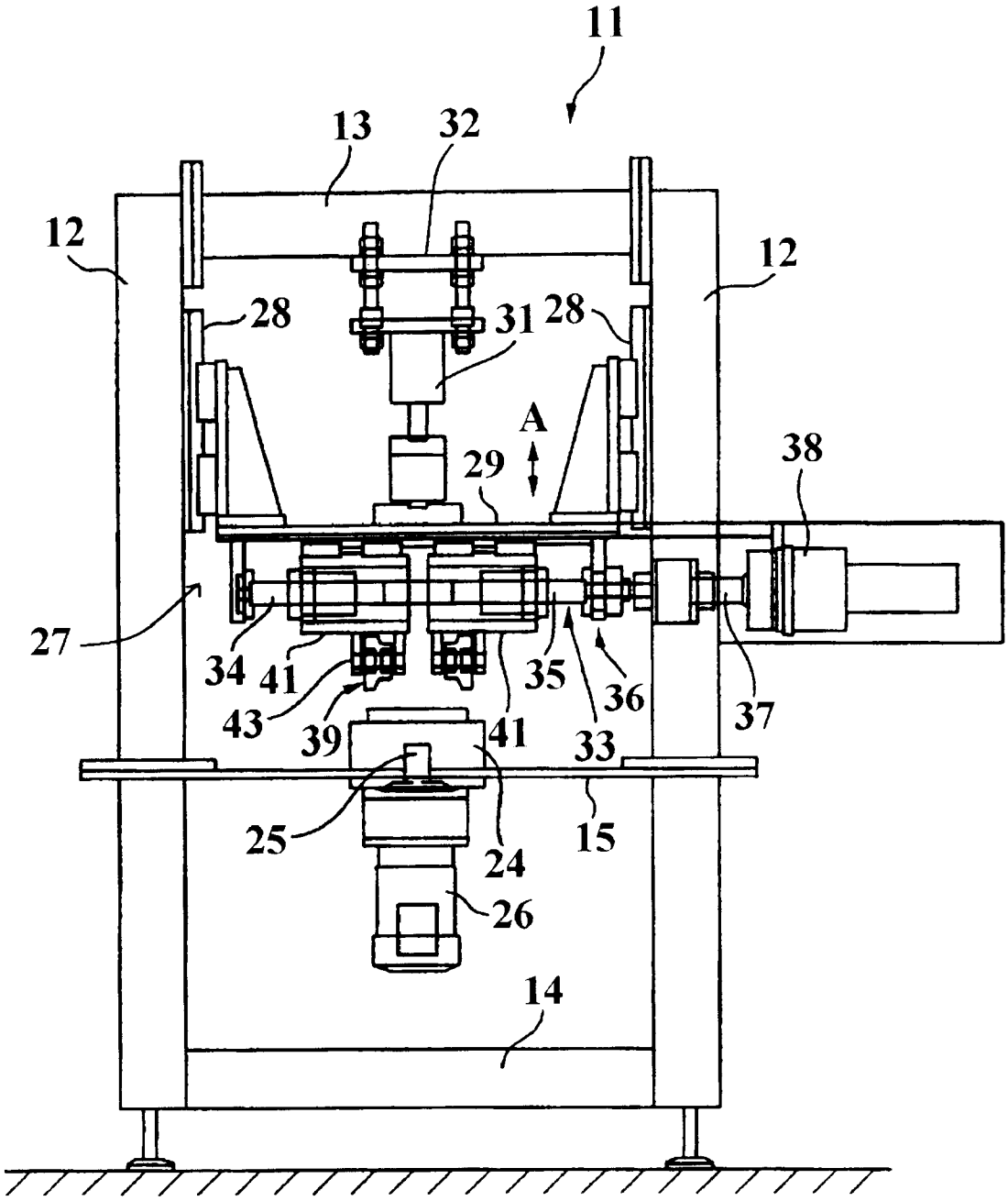
FIG. 1 is a front elevational view of an apparatus constructed in accordance with the invention and capable of performing the method of the invention.
Figure 2:
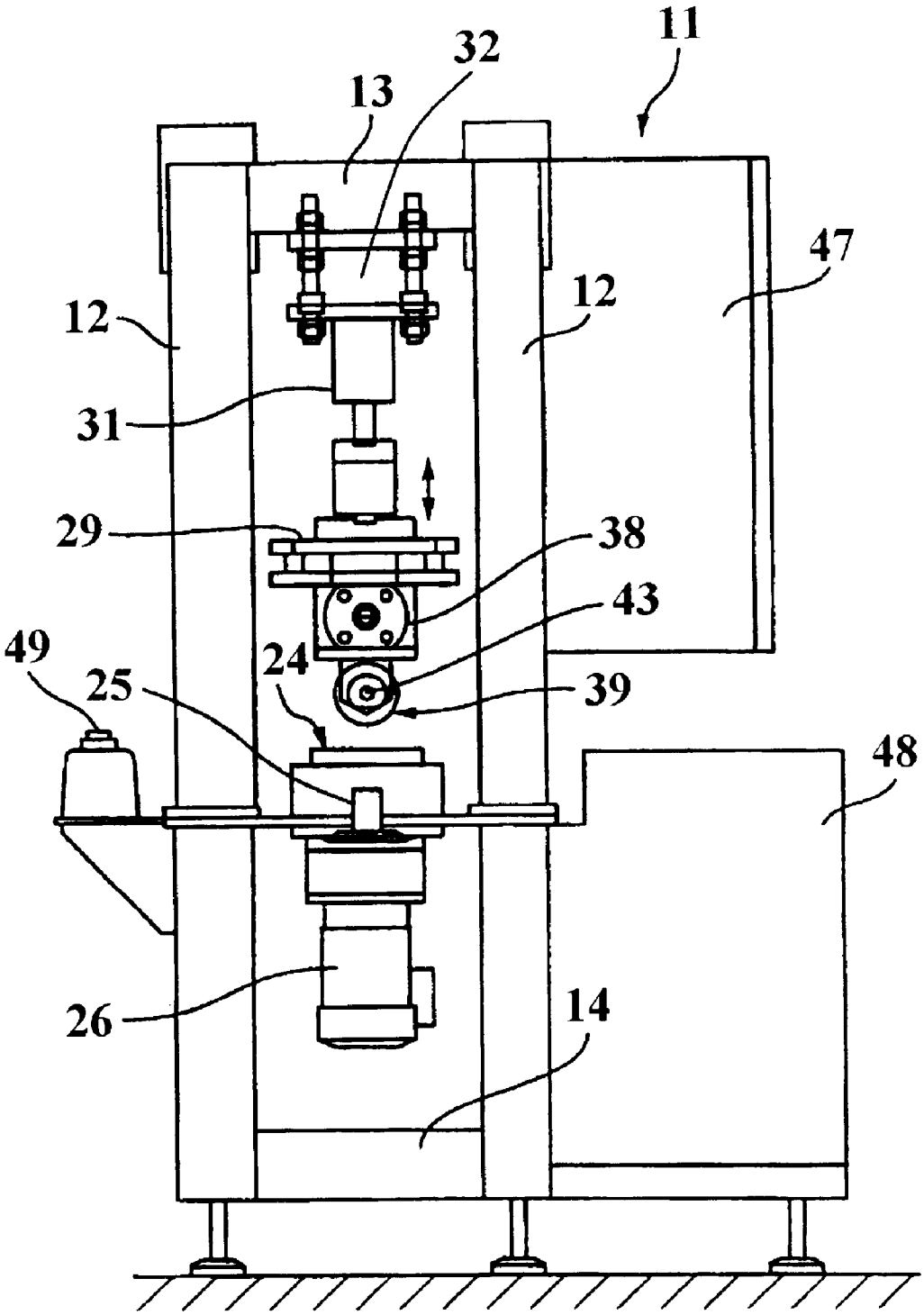
FIG. 2 is a side elevational view of the apparatus.
Figure 3:
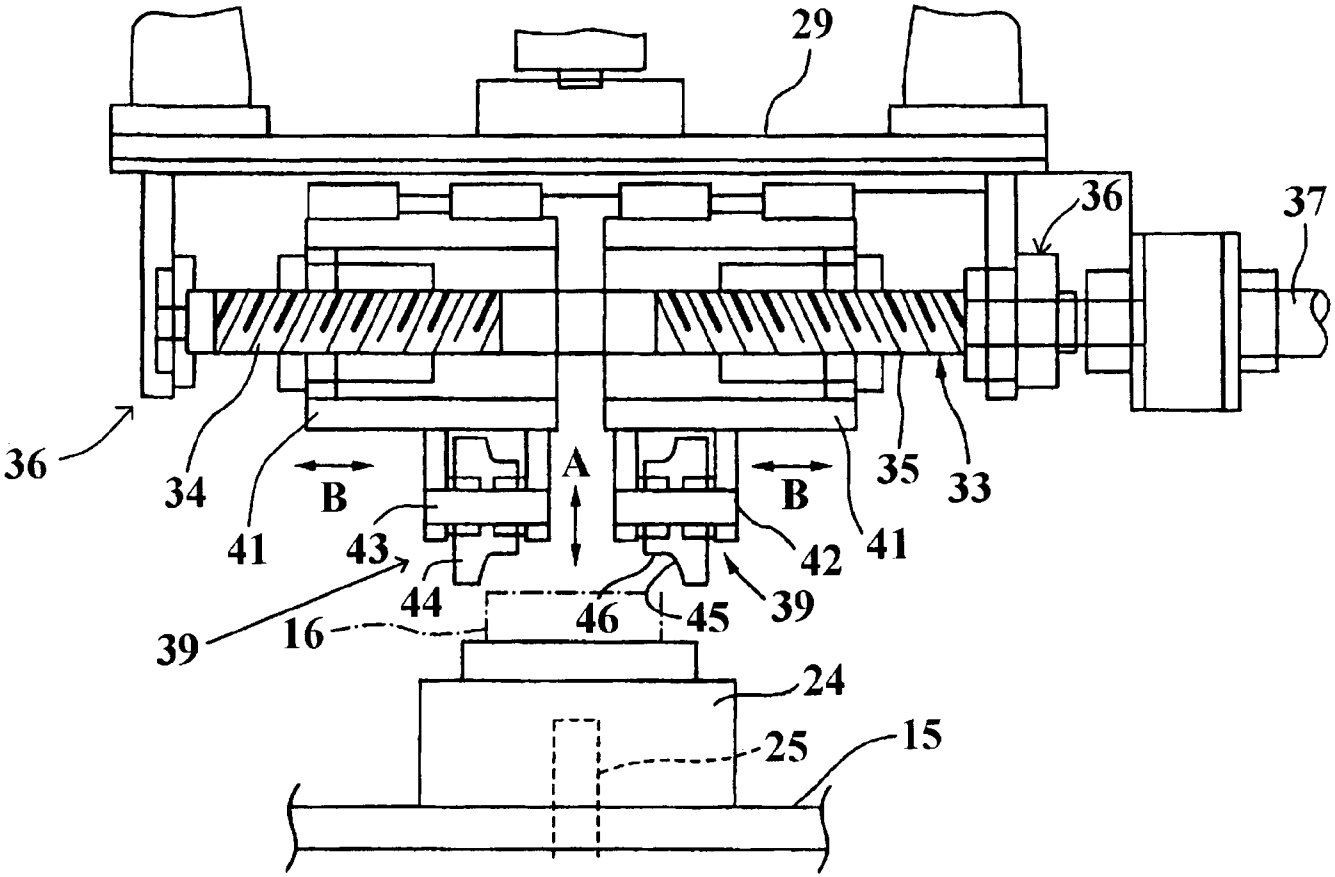
FIG. 3 is an enlarged view looking in the same direction as FIG. 1 with portions shown broken away and in section.

Referring now in detail to the drawings and initially to FIGS. 1 through 3, an apparatus for performing the method of the invention and embodying the invention is indicated generally by the reference numeral 11. The apparatus 11 includes four corner pillars 12, which are adapted to be supported on the floor. The pillars 12 are connected to each other at their upper ends by cross pieces 13 and at their lower ends by cross pieces 14 to form a rigid frame for the apparatus 11.

Figure 4:
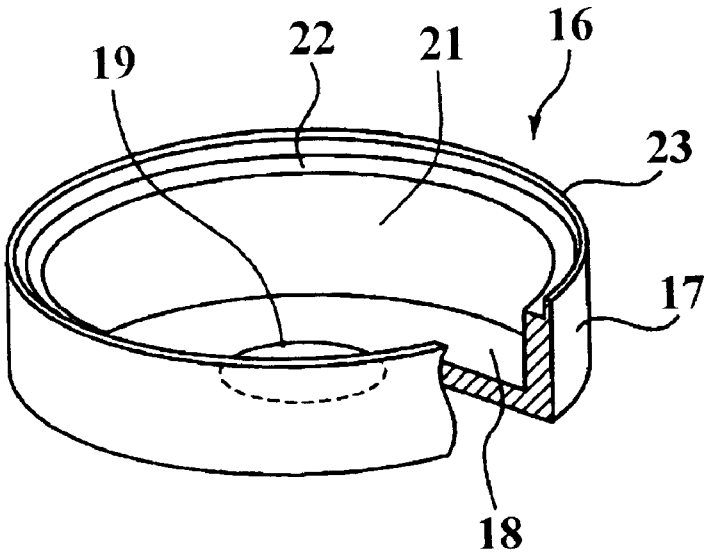
FIG. 4 is a perspective view, with a portion broken away, of a cylindrical shell which forms the magnet carrier.
Figure 5:
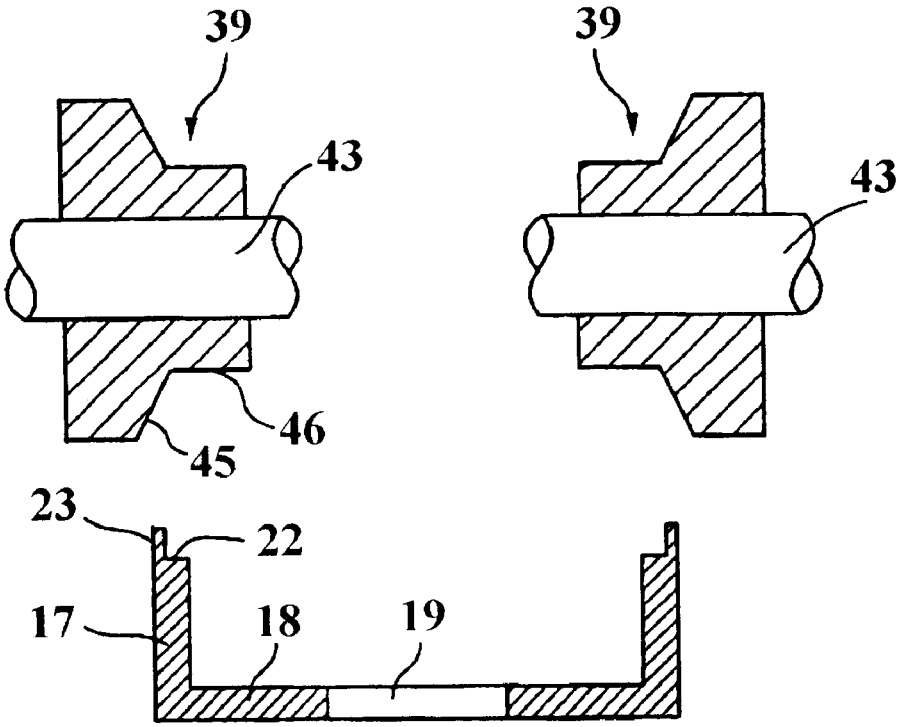
FIGS. 5–7 are is a cross sectional view looking in the same general direction as FIG. 3 and show the steps in the forming operation.

A support plate 15 is affixed to the pillars 12 at an appropriate height and is adapted to support a work piece in the form of a cylindrical ferrous material having a shape best shown in FIG. 4 and identified generally by the reference numeral 16. Referring now to FIG. 5, the workpiece 16 includes a cylindrical shell portion 17 that is at least partially closed at one end thereof by a radially inwardly extending end wall 18. The end wall 18 forms an opening 19 to pass a shaft in the completed rotating electrical machine.

A cylindrical inner surface 21 of the shell 17 is adapted to receive a plurality of circumferentially spaced permanent magnets, which may be carried in a magnet carrier of any suitable type. These magnets and carrier are positioned to engage the cylindrical surface 21 with their lower ends being supported on the end wall 18.

A ledge 22 is formed at the upper end of the surface 21 and is coextensive with the upper ends of the magnets and their carrier. A thinner peripheral flange 23 is formed on the shell and in the illustrated embodiment forms a continuation of the cylindrical section 17. This peripheral edge 23 has a length that is greater than the radial dimension of the end surface 22 for a reason which will become apparent shortly.

Referring again to the apparatus 11 and specifically FIGS. 1 through 3, the support plate 15 has mounted on it a fixture 24 that is adapted to receive the shell 16 and hold it against transverse movement. This fixture 24 is rotatably connected to a drive shaft 25 that is driven by a rotary motor 26 which may be hydraulically operated.

A moveable forming tool apparatus, indicated generally by the reference numeral 27, is supported for vertical movement in the directions indicated by the arrow A on guide rails 28 formed on the pillars 12. This moveable forming tool apparatus 27 has a base portion 29 that is connected to the piston rod of a reciprocating hydraulic cylinder assembly 31. The cylinder housing of this assembly 31 is fixed to the upper cross pieces 13 by a fastener arrangement 32.

A feed screw, indicated generally by the reference numeral 33, is rotatably journalled on the underside of the base portion 29 and has a pair of axially spaced threaded portions 34 and 35 which are of opposite hand. This feed screw 33 is journalled in a pair of spaced bearing assemblies 36 and is driven by the shaft 37 of a further rotary hydraulic motor 38.

Referring now primarily to FIG. 3, a pair of forming tool assemblies, each indicated generally by the reference numeral 39, are associated with the feed screw portions 34 and 35. These assemblies 39 include recirculating ball nuts 41 each of which cooperates with a respective one of the feed screw portions 34 and 35, so that when the feed screw 33 is rotated in one direction or the other, the assemblies 39 will move toward each other or away from each other in the directions indicated by the arrow B.

Each nut 41 has a supporting brackets 42, each of which journals a pair of shafts 43. Rotatably supported on the shafts 43 are forming tools 44. Each forming tool 44 has an angularly inclined surface 45, which forms a pre-bending section and a generally cylindrical portion 46 which forms the final bending operation. These operations will be described shortly in more detail.

Referring now back primarily to FIGS. 1 and 2, the apparatus further includes a control panel 47 that controls the operation of the reciprocating hydraulic motor 31 and the rotating hydraulic motors 26 and 38. The hydraulic system for these operations is shown schematically at 48 and is contained within a hydraulic circuit assembly.

Figure 6:
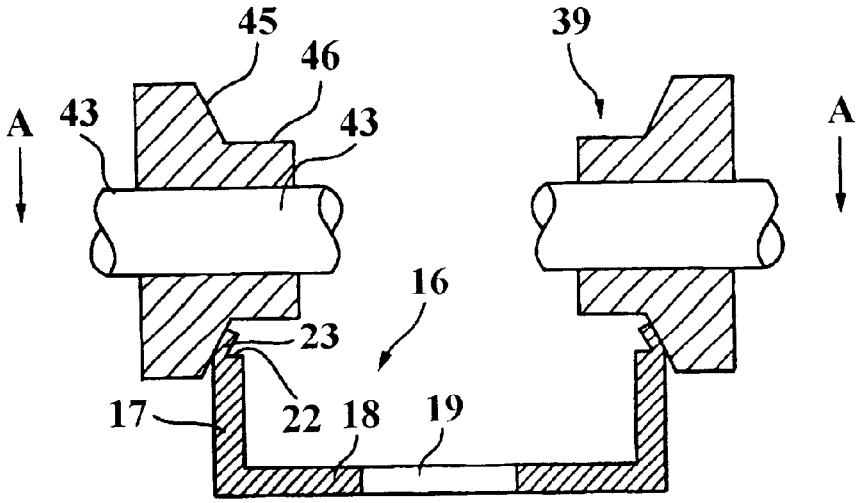
Figure 7:
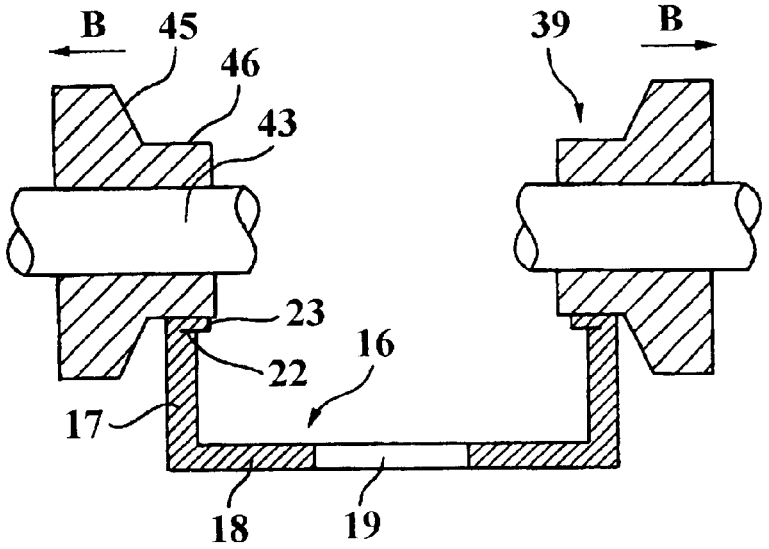

An operator start switch 49 is conveniently positioned on the machine so that the operator can initiate the forming operation, which will now be described by primary reference to FIGS. 5 through 7. As may be best seen in FIGS. 5 through 7, the forming tool forming sections 45 and 46 are disposed at an angle to each other. In the illustrated embodiment, the section 45 is a cone of revolution and thus has a planar configuration in cross section. It is also to be understood that this shape could be of a concave curve and in any event terminates at the section 46, which extends parallel to the work piece face 18 and surface 22.

In operation, a work piece 16 with the permanent magnets and the magnet carrier in place is positioned on the support 24 and specifically in confronting relationship to the forming tools 39. It should be noted that the permanent magnets may magnetized before being inserted into the shell or may be magnetized thereafter.

Initially, the feed screw 33 is rotated in a direction to cause the forming tools 39 to be positioned so that their pre-forming sections 45 are disposed immediately above the extending flange 23 of the shell 16. Then, the device is lowered by actuation of a hydraulic cylinder 31 so as to bring the sections 45 of the forming tools into engagement with the flange 23 as shown in FIG. 6 so as to partially deflect it. The workpiece 16 is rotated so that the entire circumferential extent of the flange 23 is pre-bent.

Then, the feed screw is rotated so as to move the forming tools 39 away from each other and to bring the final forming sections 46 into registry above the top of the bent flange 23. Then, the device is further lowered and rotated so as to complete the forming operation.

Thus, it should be readily apparent that the apparatus prevents both the pre-forming and final bending to be accomplished in the same station and in successive steps. Also, because of this construction the apparatus is capable of affixing magnet carriers having widely different diameters. Of course, the foregoing description is that of preferred embodiment of the invention and various changes and modifications may be made without departing from the spirit and scope of the invention, as defined by the appended claims.

What is claimed is:

1. A machine for folding over a peripheral flange of a cylindrical shell comprising a support for the shell; a forming tool having a pre-bending section and a final bending section angularly related to each other about a plane extending parallel to said support; a drive (1) effecting relative axial movement of said support and said forming tool to bring said forming tool into engagement with a peripheral flange of a shell positioned on said support, (2) effecting relative radial movement of said support and said forming tool for determining which section of said forming tool engages the peripheral flange of the shell positioned on said support independently of the relative axial movement and (3) effecting relative rotation of said support and said forming tool to deform a circumferential portion of the peripheral flange of the shell positioned on said support; and a control operating said drive for first partially bending the peripheral flange of the shell positioned on said support around a circumferential area by said pre-bending section of said forming tool and then completing the bending thereof by said final bending section of said forming tool.

2. A machine as set forth in claim 1, wherein the pre-bending section is inclined to the plane extending parallel to the support.

3. A machine as set forth in claim 1, wherein the final bending section is parallel to the plane extending parallel to the support.

4. A machine as set forth in claim 3, wherein the pre-bending section is inclined to the plane extending parallel to the support.

5. A machine as set forth in claim 1, wherein there are a pair of forming tools circumferentially spaced from each other for bending different circumferential portions of the peripheral flange of the shell at the same time.

6. A machine as set forth in claim 5, wherein the forming tools are rotational about respective axes.

7. A machine as set forth in claim 6, wherein the forming tools axes are coincident.

8. A machine as set forth in claim 6, wherein the forming tools axes are movable in the direction of their axes under the operation of the control to determine which section thereof engages the peripheral flange of the shell.

9. A machine as set forth in claim 7, wherein the pre-bending section is inclined to the plane extending parallel to the support.

10. A machine as set forth in claim 7, wherein the final bending section is parallel to the plane extending parallel to the support.

11. A machine as set forth in claim 10, wherein the pre-bending section is inclined to the plane extending parallel to the support.

12. A machine as set forth in claim 11, wherein the pre-bending section is planar.

13. A machine as set forth in claim 11, wherein the pre-hending section is curved.

14. A machine as set forth in claim 5, wherein the forming tools are carried by a common carriage and are supported for axial movement thereto to determine which section thereof engages the peripheral flange of the shell.

15. A machine as set forth in claim 14, wherein the pre-bending sections of the forming tools are disposed radially outwardly from the final bending sections.

16. A method of forming a magnet assembly for a rotating electrical machine comprising the steps of forming a shell having a cylindrical section open at one end and having an extending section thereof at the open end of the shell to form a ledge at the open end and at least partially closed at its other end by a radially extending end wall extending radially inwardly from the cylindrical section, placing a plurality of magnetic sections within the shell with their outer periphery in engagement with the inner surface of the cylindrical section and one end thereof in engagement with the ledge of the end wall, initially bending the extending section of the shell toward the magnetic sections by bringing a first section of a forming tool into axial contact therewith and then continuing to bend a circumferential extent of the extending section by effecting relative rotation between the shell and the forming tool around the axis of the cylindrical section, and finally completing the bending of the extending section into locking engagement with the magnetic sections by bringing a second section of the forming tool into contact with the extending section and effecting relative rotation between the shell and the forming tool around the axis of the cylinidrical section.

17. A method of forming a magnet assembly for a rotating electrical machine as set forth in claim 16 wherein the entire circumferential extent of the shell extending section is bent by using a plurality of circumferentially spaced forming tools each having like configured first and second sections.

18. A method of forming a magnet assembly for a rotating electrical machine as set forth in claim 16 wherein the extending section of the shell is formed to have a lesser radial width than the remaining part of the cylindrical section to form the ledge.

19. A method of forming a magnet assembly for a rotating electrical machine as set forth in claim 18 wherein the entire circumferential extent of the shell extending section is bent by using a plurality of circumferentially spaced forming tools each having like configured first and second sections.

* * * * *